US009074741B2

(12) United States Patent
Ding

(10) Patent No.: US 9,074,741 B2
(45) Date of Patent: Jul. 7, 2015

(54) DYNAMIC SIMULATING ELECTRONIC CANDLE

(71) Applicant: Nantong Ya Tai Candle Arts & Crafts Co., Ltd., Nantong, Jiangsu Province (CN)

(72) Inventor: Yingqi Ding, Nantong (CN)

(73) Assignee: Nantong Ya Tai Candle Arts & Crafts Co., Ltd., Nantong (CN)

( * ) Notice: Subject to any disclaimer, the term of this patent is extended or adjusted under 35 U.S.C. 154(b) by 0 days.

(21) Appl. No.: 14/165,894

(22) Filed: Jan. 28, 2014

(65) Prior Publication Data

US 2015/0124464 A1 May 7, 2015

(30) Foreign Application Priority Data

Nov. 6, 2013 (CN) ..... 2013 1 0542152

(51) Int. Cl.
*F21L 4/00* (2006.01)
*F21S 6/00* (2006.01)

(52) U.S. Cl.
CPC ..... *F21S 6/001* (2013.01)

(58) Field of Classification Search
CPC ..... F21S 10/04; F21S 6/001; F21K 9/58; F21V 35/00
USPC ..... 362/392, 161
See application file for complete search history.

(56) References Cited

U.S. PATENT DOCUMENTS 7,387,411 B1 * 6/2008 Tsai ..... 362/392
8,789,986 B2 * 7/2014 Li ..... 362/393

* cited by examiner

*Primary Examiner* — Anabel Ton
(74) *Attorney, Agent, or Firm* — Rankin, Hill & Clark LLP

(57) ABSTRACT

The present invention discloses a dynamic simulating electronic candle, which includes a candle body, wherein a cavity is arranged inside the candle body, a light-emitting unit including a power supply box and a lamp holder arranged above the power supply box is installed inside the cavity. A bottom plate is fixedly arranged inside the lamp holder, a slot is formed in the bottom plate, a flame front is fixedly installed on the slot, a control plate is mounted below the bottom plate, fixed bases are oppositely arranged at two sides of the slot in the bottom plate and are positioned in front and rear of the flame front, lamp holes are formed in the fixed bases, and light-emitting bodies are installed in the lamp holes and connected to the control plate. The dynamic simulating electronic candle disclosed by the present invention has the characteristics of simple structure, low cost and good swinging simulating effect.

10 Claims, 3 Drawing Sheets

DYNAMIC SIMULATING ELECTRONIC CANDLE

TECHNICAL FIELD

The present invention relates to an electronic candle, and in particular, to a dynamic simulating electronic candle with a swinging candle wick.

BACKGROUND ART

Since its introduction, an electronic candle has enjoyed more and more advocacies from people for its safety and convenience, energy saving and environmental friendliness, and especially in Europe and America, has a trend of gradually replacing traditional candles.

However, most of existing electronic candles have only a single-colored light-emitting body with no dynamic effect and no feeling of flickering lights, and is lack of reality and a high degree of simulation; or some electronic candles with swinging functions are invented, but those are complex in swinging structure inside and higher in cost.

SUMMARY OF THE INVENTION

Invention Object: the object of the present invention is to provide an electronic candle integrating seven-colored light emitting and swinging functions for solving the defect of the prior art. The electronic candle is capable of simulating the dynamic effect of the flame front of a candle.

Technical Solution: the seven-colored swinging electronic candle described in the present invention comprises a candle body, a cavity is arranged inside said candle body, a light-emitting ing unit with more than two light-emitting bodies is located inside said cavity, a flame front is installed at the top of said candle body, wherein the front and back sides of said flame front is illuminated by said light-emitting bodies, a control plate is connected with said light-emitting unit to control said light-emitting bodies flickering or illuminating.

It is preferred that wherein said light-emitting unit includes a power supply box and a lamp holder arranged above the power supply box, a bottom plate is fixedly arranged inside the lamp holder, a slot is formed in the bottom plate, a flame front is fixedly installed on said slot, a control plate is mounted below said bottom plate, the fixed bases are oppositely arranged at two sides of said slot, and the fixed bases are positioned in front and rear of said flame front, the lamp holes are formed in said fixed bases, and said light-emitting bodies are installed in the lamp holes and connected to said control plate.

It is preferred that wherein said fixed bases positioned in front and rear of the flame front are respectively provided with one lamp hole.

It is preferred that wherein a light-emitting body in the lamp hole in front of the flame front is of a normally-on type, and a light-emitting body in the lamp hole in rear of the flame front is of a flickering type.

It is preferred that a light-emitting body in the lamp hole in front of the flame front is of a flickering type, and a light-emitting body in the lamp hole in rear of the flame front is of a flickering type.

It is preferred that wherein a light-emitting body in the lamp hole in front of the flame front is of a brightness gradually-changing type, and a light-emitting body in the lamp hole in rear of the flame front is of a brightness gradually-changing type.

It is preferred that wherein two adjacent lamp holes are formed in the fixed base positioned in front of the flame front, and one lamp hole is formed in the fixed base positioned in rear of the flame front.

It is preferred that wherein light-emitting bodies in two adjacent lamp holes in the fixed base in front of the flame front are of flickering types, and a light-emitting body in one lamp hole in the fixed base in rear of the flame front is of a flickering type.

It is preferred that wherein said light-emitting bodies in two adjacent lamp holes of said fixed base in front of said flame front are of flickering types, a light-emitting body in one lamp hole of said fixed base which is in rear of the flame front illuminates colorful light.

It is preferred that wherein an angle between a light-emitting body and a fixed base is 45°.

It is preferred that wherein an upper cover is also arranged above the lamp holder and is of an annular structure, the flame front sequentially passes through the lamp holder, the upper cover and a through hole, and a flame is simulated on the upper surface of the candle body.

Beneficial Effects: according to the dynamic simulating electronic candle disclosed by the present invention, the flame front is fixed stilly to ensure that the structure inside the dynamic simulating electronic candle is simplified; and light-emitting bodies are arranged in front and rear of the flame front to ensure that light on the flame front is brightness gradually-changing, thereby generating a dynamic swinging effect; and such mode simplifies the structure inside the dynamic simulating electronic candle, greatly reduces the production cost and may generate a dynamic swinging effect.

SPECIFIC EMBODIMENTS

Embodiment 1

Figure 1:
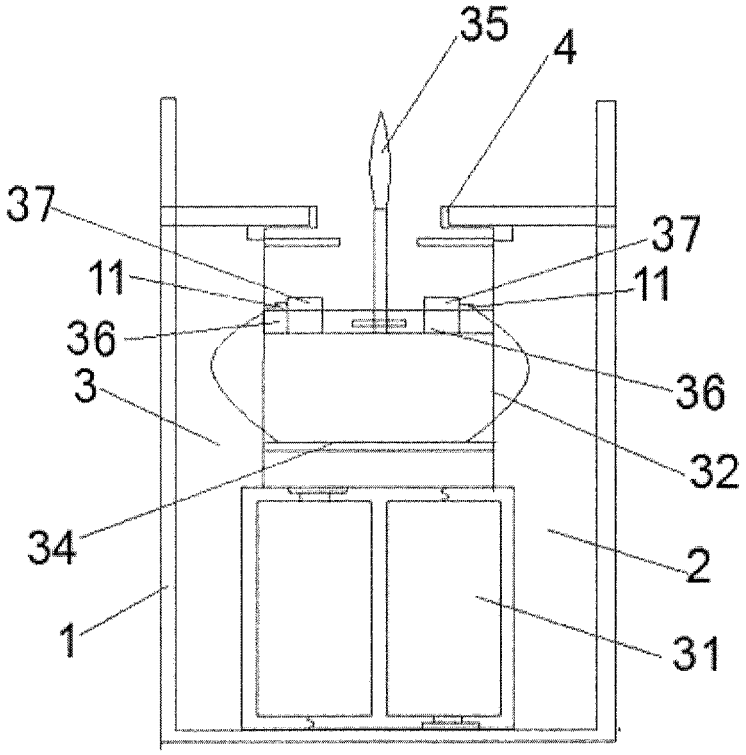
FIG. 1 is a sectional view of an electronic candle disclosed by the embodiment 1 of the present invention.
Figure 2:
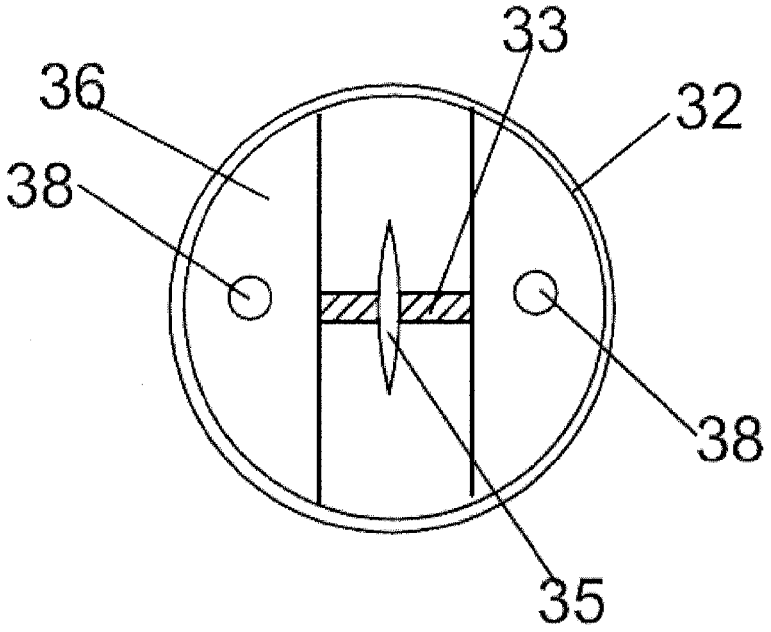
FIG. 2 is a top view 1 of a candle wick of an electronic candle disclosed by the embodiment 1 of the present invention.

As shown in FIGS. 1 and 2, a dynamic simulating electronic candle replaces a conventional ignition candle, with swinging effect of flame front. The electronic candle includes a candle body 1, wherein a cavity 2 is formed inside the candle body 1. a light-emitting unit with an upper cover 4 is located inside said cavity.

To be specific, the candle body 1 may be waxy and plastic, and may also be formed by filling wax liquid or wax in a glass container or transparent container.

The light-emitting unit includes a power supply box 31, a lamp holder 32, a bottom plate 33, a control plate 34, a flame front 35 and fixed bases 36, wherein the lamp holder 32 is arranged above the power supply box 31. A slot 38 with through holes 11 is formed above the control plate 34. The flame front 35 extending to the upper cover 4 is fixed on the slot 38, to simulate the real flame outside the candle body 1. The bottom plate 33 is fixedly arranged inside the lamp holder 32. The control plate 34 is installed in the lamp holder 32 and located below the bottom plate 33. The fixed bases 36 respectively positioned at root parts in front and rear of the flame front 35, are oppositely arranged on two sides of the slot 38 on the bottom plate 33. The fixed bases 36 are arranged in a certain angle with the bottom of the flame front 35. The lamp holes 37 are formed in the fixed bases 36. The light-emitting bodies are installed in the lamp holes 37, and the light-emitting bodies are connected to the control plate 34. The light-emitting bodies 38 located on the fixed bases which are on the front and rear sides of the flame front respectively, illuminate on the front surface and the rear surface of the flame front.

Figure 3:
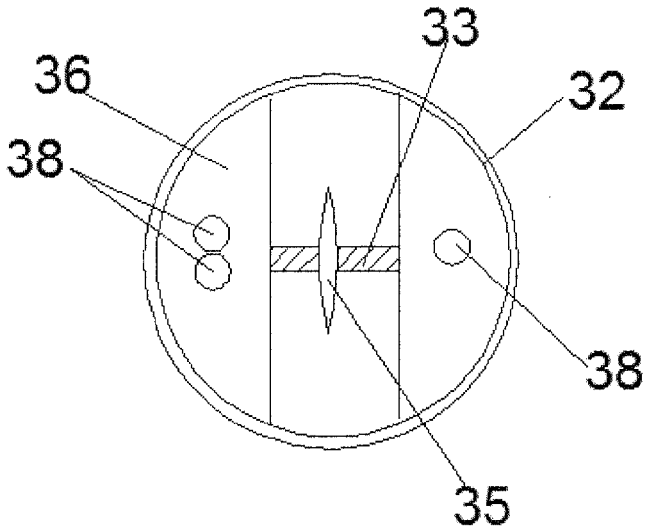
FIG. 3 is a top view 2 of a candle witch of an electronic candle disclosed by the embodiment 2 of the present invention.
Figure 4:
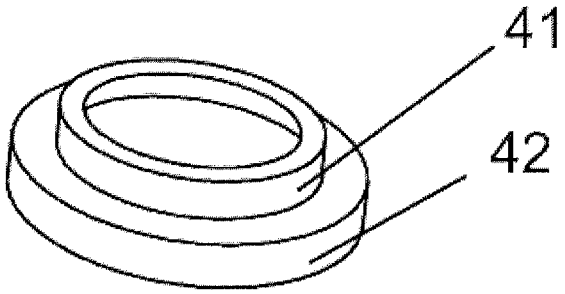
FIG. 4 is a schematic structural diagram of an upper cover disclosed by the embodiment 2 of the present invention.

Shown in FIG. 3, the upper cover 4 is of an annular structure, including an upper part 41 which is sticking up and a lower part 42, wherein the diameter of the lower part 42 is more than that of the upper part 41.

The fixed bases 36 located on front and rear sides of the flame front 35 are respectively equipped with two light-emitting bodies.

The light-emitting body 38 in the lamp hole 37 in front of the flame front 35 is of a normally-on type, and the light-emitting body in the lamp hole 37 in rear of the flame front 35 is of a flickering type.

Alternatively, the light-emitting body in the lamp hole 37 in front of the flame front 35 is of a flickering type, and the light-emitting body in the lamp hole 37 in rear of the flame front 35 is of a flickering manner.

The light-emitting body located on front or/and rear side of the flame front 35 is/are of brightness gradually-changing types.

The principle of the dynamic simulating electronic candle disclosed by the present invention is as follows:

(1) The light-emitting bodies are of flickering types LED. a battery is installed in the power supply box 31 to form a circuit. When the power supply is turned on, the control plate 34 drives the light-emitting bodies to start flickering to alternatively illuminate the front surface and the rear surface of the flame front 35, so that the flame front 35 generates a dynamic on-off swinging effect.

(2) The light-emitting bodies are of brightness gradually-changing types: A battery is installed in the power supply box 31 to form a circuit. When the power supply is turned on, the control plate 34 drives the light-emitting bodies to emit light, and at this moment, the brightness gradually-changing light-emitting bodies slowly brighten and then slowly darken to irradiate the front surface and the rear surface of the flame front 35, so that the flame front 35 generates a dynamic on-off swinging effect.

(3) One light-emitting body is of a normally-on type and the other one is of a flickering type: a battery is installed in the power supply box 31 to form a circuit. When the power supply is turned on, the control plate 34 drives the light-emitting bodies to start flickering, the light-emitting body in the front directly illuminate on the front surface of the flame front, and the flickering light-emitting body in the rear illuminate on the rear surface of the flame front 35 in a flickering manner, so that the flame front 35 generates a dynamic on-off swinging effect.

According to the dynamic swinging electronic candle disclosed by the present invention, a complex structure of a swinging candle with simulated swinging flame front is saved in terms of the structure; and by controlling light of the light-emitting bodies, a swinging effect is generated.

Embodiment 2

Two adjacent lamp holes 37 are formed in the fixed base 36 positioned in front of the flame front 35, and one lamp hole 37 is formed in the fixed base 36 located in rear of the flame front 35.

The light-emitting bodies in the two adjacent lamp holes 37 in the fixed base 36 in front of the flame front 35 are also of flickering types, and a light-emitting body in one lamp hole 37 in the fixed base 36 in rear of the flame front 35 is of a flickering type. Alternatively, a light-emitting body in one lamp hole 37 of the fixed base 36 which is on rear side of the flame front 35 is of a seven-colored type.

The technical content and technical characteristics of the present invention have been disclosed as above, however, a person skilled in the art always may possibly make substitutions and modifications without deviating from the principle of this invention on the basis of demonstration and disclosure of the present invention, therefore, the protection scope of the present invention shall include various substitutions and modifications without deviating from this invention but not be limited to the content disclosed by the embodiment, and falls within the claim of the patent application.

The invention claimed is:

1. A dynamic simulating electronic candle, comprising:
- a candle body;
- a cavity is arranged inside said candle body;
- a light-emitting unit with more than two light-emitting bodies is located inside said cavity;
- a flame front is installed at a top of said candle body;
- wherein front and back sides of said flame front are illuminated by said light-emitting bodies;
- a control plate is connected with said light-emitting unit to control said light-emitting bodies flickering or illuminating;
- wherein said light-emitting unit includes a power supply box and a lamp holder arranged above the power supply box;
- a bottom plate is fixedly arranged inside the lamp holder;
- a slot is formed in the bottom plate;
- said flame front is fixedly installed on said slot;
- said control plate is mounted below said bottom plate;
- fixed bases are oppositely arranged at two sides of said slot, and the fixed bases are positioned in front and rear of said flame front;
- lamp holes are formed in said fixed bases, and said light-emitting bodies are installed in the lamp holes and connected to said control plate.

2. The dynamic simulating electronic candle according to claim 1,
- wherein said fixed bases positioned in front and rear of the flame front are respectively provided with one lamp hole.

3. The dynamic simulating electronic candle according to claim 2,
- wherein a light-emitting body in the lamp hole in front of the flame front is of a normally-on type, and a light-emitting body in the lamp hole in rear of the flame front is of a flickering type.

4. The dynamic simulating electronic candle according to claim 2,
- wherein a respective light-emitting body in the lamp hole in front of the flame front is of a flickering type, and a respective light-emitting body in the lamp hole in rear of the flame front is of a flickering type.

5. The dynamic simulating electronic candle according to claim 2,
- wherein a respective light-emitting body in the lamp hole in front of the flame front is of a brightness gradually-changing type, and a respective light-emitting body in the lamp hole in rear of the flame front is of a brightness gradually-changing type.

6. The dynamic simulating electronic candle according to claim 1, wherein two adjacent lamp holes are formed in said fixed base positioned in front of the flame front, and one lamp hole is formed in the fixed base positioned in rear of the flame front.

7. The dynamic simulating electronic candle according to claim 6, wherein light-emitting bodies in two adjacent lamp holes in the fixed base in front of the flame front are of flickering types, and a light-emitting body in one lamp hole in the fixed base in rear of the flame front is of a flickering type.

8. The dynamic simulating electronic candle according to claim 6, wherein said light-emitting bodies in two adjacent lamp holes of said fixed base in front of said flame front are of flickering types;

a light-emitting body in one lamp hole of said fixed base which is in rear of the flame front illuminates colorful light.

9. The dynamic simulating electronic candle according to claim 1, wherein an angle between one of said light-emitting bodies and one of said fixed bases is 45°.

10. The dynamic simulating electronic candle according to claim 1, wherein an upper cover is also arranged above the lamp holder and is of an annular structure, the flame front sequentially passes through the lamp holder, the upper cover and a through hole, and a flame is simulated on the upper surface of the candle body.

* * * * *